United States Patent [19]

Mayer

[11] Patent Number: 4,592,255

[45] Date of Patent: Jun. 3, 1986

[54] RATCHET WRENCH WITH MULTIPLE TOOLS

[76] Inventor: Albin F. Mayer, 2920 Pilot Knob Rd, Eagan, Minn. 55121

[21] Appl. No.: 765,364

[22] Filed: Aug. 13, 1985

Related U.S. Application Data

[63] Continuation of Ser. No. 563,998, Dec. 21, 1983, abandoned.

[51] Int. Cl.[4] ..... B25B 13/46

[52] U.S. Cl. ..... 81/63; 81/62

[58] Field of Search ..... 81/63, 62

[56] References Cited

U.S. PATENT DOCUMENTS

| | | | |
|---|---|---|---|
| 193,301 | 7/1877 | Vassar | 81/62 |
| 455,133 | 6/1891 | Thring | 81/62 |
| 625,149 | 5/1899 | Crocker | 81/63 |
| 837,537 | 12/1906 | Beyer | 81/62 |
| 864,007 | 8/1907 | Lyon . | |
| 896,607 | 8/1908 | Zeller . | |
| 898,806 | 9/1908 | Walker . | |
| 915,446 | 3/1909 | Kearnes | 81/63 |
| 1,012,881 | 12/1911 | Marsh | 81/62 |
| 1,119,900 | 12/1914 | Vacarezza . | |
| 1,391,677 | 9/1921 | Foss | 81/62 |
| 2,058,855 | 10/1936 | Chapman | 81/63 |
| 2,500,835 | 3/1950 | Lang . | |
| 2,708,855 | 5/1955 | Fish . | |
| 3,077,801 | 2/1963 | Rostad . | |
| 3,967,514 | 7/1976 | Deutch | 81/63 |
| 4,016,782 | 4/1977 | Guimarin . | |
| 4,080,851 | 3/1978 | Rogers . | |
| 4,254,675 | 3/1981 | Marlow et al. . | |
| 4,259,883 | 4/1981 | Carlson . | |
| 4,261,233 | 4/1981 | Konecny . | |
| 4,318,315 | 3/1982 | Washburn . | |

*Primary Examiner*—Frederick R. Schmidt
*Assistant Examiner*—J. T. Zatarga
*Attorney, Agent, or Firm*—Paul L. Sjoquist

[57] ABSTRACT

A handle member having at least one circular opening proximate an end, and having a ratchet pawl engageable proximate the opening, and having a spring biased finger engageable into and out of the opening, with mechanical linkage for disengaging the ratchet pawl when the finger is disengaged from the opening, and including a plurality of tools having a generally cylindrical construction for insertion into the opening, each tool having a circumferential stop thereabout for engagement by the finger, and having circumferential ratchet teeth engageable by the ratchet pawl, whereby engagement of the finger against the circumferential stop holds the tool in the handle and permits ratcheting wrench action, and disengagement of the finger from the stop also disengages the ratchet pawl and permits the tool to be released from the handle opening.

13 Claims, 12 Drawing Figures

Fig 11.A

RATCHET WRENCH WITH MULTIPLE TOOLS

This is a continuation of U.S. Ser. No. 563,998, filed Dec. 21, 1983, and now abandoned.

BACKGROUND OF THE INVENTION

This invention relates generally to tools having ratchet drive action, such as wrenches and the like, and more particularly to ratchet wrenches of the type having a single handle engageable with a plurality of tools for delivering a ratchet drive action.

The prior art shows a wide variety of ratchet wrench devices, including ratchet wrench devices having multiple tools attachable thereto. The most commercially successful wrenches of this general class have been the well-known socket wrench combinations, wherein a plurality of sockets are constructed for accommodating different nut sizes, each of them having a common size opening, usually square, for insertion into a ratchet handle having a projecting square shank. Such wrenches are widely used throughout the world in a wide variety of sizes. In the United States, socket wrenches are commonly sold having $\frac{1}{8}$-inch, $\frac{1}{4}$-inch, $\frac{3}{8}$-inch and $\frac{1}{2}$-inch shanks as drive members, with socket sets designed to accommodate these drive shanks. Further, a large number of adapters of various types have been developed for attachment to the drive shanks on wrenches of this type, in order to more readily accommodate the wrenches to different work situations.

A second general class of ratchet wrenches which have been widely accepted are box end wrenches having a ratcheting insert proximate one or both ends of a wrench handle. These wrenches are typically characterized by a handle member having a different sized ratcheting nut receiving tool proximate each end of the handle, wherein the nut receiving tools are permanently mounted in the handle. This class of wrenches usually requires a handle for each different pair of nut receiving tools, and thereby necessitates a collection of handles in order to accommodate a wide range of nut sizes. The advantage of this class of wrenches over the typical socket wrench is in that they are generally constructed with a narrow profile and are therefore more accessible into small openings for access to nuts which are hard to reach. The disadvantage of this class of wrench is that each handle will accommodate only two nut receiving tools, and therefore a workman must acquire a collection of these wrenches in order to effectively work on a wide variety of nut and bolt sizes. The ratchet mechanism for this class of wrench is typically uni-directional, requiring that the wrench be turned to one side or the other, depending upon whether a nut is to be loosened or tightened.

Common socket wrenches typically require two hands for inserting and removing the tool from the wrench drive mechanism. Some socket wrenches have a button-actuated spring-loaded detent which may be depressed with one hand, while the other hand readily removes the socket tool, while other socket wrenches require the removal of the tool by pulling it away from a spring-loaded detent mounted in the drive shank. In either case, two hands are required for this operation. Conversely, common socket wrenches suffer from the further disadvantage that on occasion the tool becomes separated from the drive mechanism by becoming jammed against a nut or bolt during use. In these cases it becomes necessary to forcefully remove the tool from its jammed position after the handle drive mechanism has slipped from engagement with the tool.

There is a need for a ratchet wrench mechanism which avoids the disadvantages summarized above, wherein the tool may be engaged and disengaged from the wrench with a one-hand operation, and wherein the tool is positively locked into engagement with the handle drive mechanism during use so that there is no way for the tool to become disengaged or separated from the handle mechanism unless the operator intends such disengagement to occur. Further, there is a need to provide a ratchet mechanism having the relatively thin profile of the second type of ratchet wrench described above, while at the same time having the capability of accepting multiple tools as described with reference to the socket wrench style summarized above.

It is therefore a principal object of the present invention to provide a ratchet drive member capable of ratcheting operation, and which is usable with a plurality of tools which may be readily engaged and disengaged from the handle.

It is a further object of the present invention to provide a ratchet drive mechanism and tool combination which is a amenable to one-hand operation.

It is a further object of the present invention to provide a ratchet drive handle mechanism which is adaptable for operation with socket tools of the type commonly used in commerce.

SUMMARY OF THE INVENTION

The present invention includes a handle drive mechanism having a ratchet pawl incorporated therein, the handle drive mechanism having at least one circular opening proximate an end thereof, wherein the ratchet pawl is engageable proximate the opening, and wherein a slidable finger is selectively engageable into the opening, and mechanically connected to the ratchet pawl mechanism for slidably moving the ratchet pawl into disengagement when the finger is disengaged from the opening, and further comprising a plurality of tools, each tool having a generally cylindrical shape for insertion into the opening, and having a circumferential stop sized for engagement by the finger, and having circumferential ratchet teeth engageable by the ratchet pawl.

BRIEF DESCRIPTION OF THE DRAWINGS

The foregoing objects and advantages of the invention are disclosed in the specification hereto, and with reference to the appended drawings, in which:

FIG. 11A shows a ratchet pawl engaged in a first position; and

DESCRIPTION OF THE PREFERRED EMBODIMENT

Figure 1:
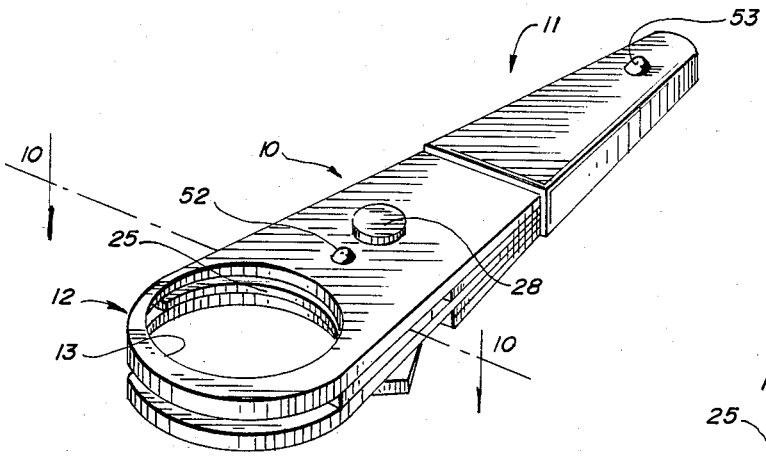
FIG. 1 shows a top isometric view of the invention.

Referring first to FIG. 1, a preferred embodiment of the invention is shown in isometric top view. In this view, handle drive mechanism 10 is shown without a corresponding tool attached thereto. Handle drive mechanism 10 includes a handle 11 and at least one head 12. The preferred embodiment of the invention is described herein with reference to a single head 12 proximate an end of handle 11, but it is to be understood that the invention could equally well be constructed having two heads, one proximate each end of handle 11. This alternative embodiment is particularly adaptable in cases wherein a wide variety of tools is to be used with handle drive mechanism 10, for in this case different size bores may be made proximate respective ends of handle 11.

A circular head bore 13 is constructed in head 12. Bore 13 is constructed of a predetermined diameter, and if desired a second bore may be constructed proximate the other end of handle 11, of larger or smaller size. In the preferred embodiment, handle drive mechanism 10 is constructed from a plurality of layers of sheet steel which are affixed together as by riveting or other fastening techniques. The individual steel sections which form the layers are shaped in the manner to be hereinafter described, to provide for space for mounting and moving certain mechanical parts of the apparatus. Rivets 52 and 53 hold the respective layers of sheet steel together to form all of the functional components of handle drive mechanism 10.

A slidable release button 28 projects from one side of handle drive mechanism 10, and is mechanically linked to a slidable retainer plate 25 which will be further explained hereinbelow. Retainer plate 25 may be moved into projecting engagement in bore 13 and may be withdrawn therefrom, by sliding movement of release button 28.

Figure 2:
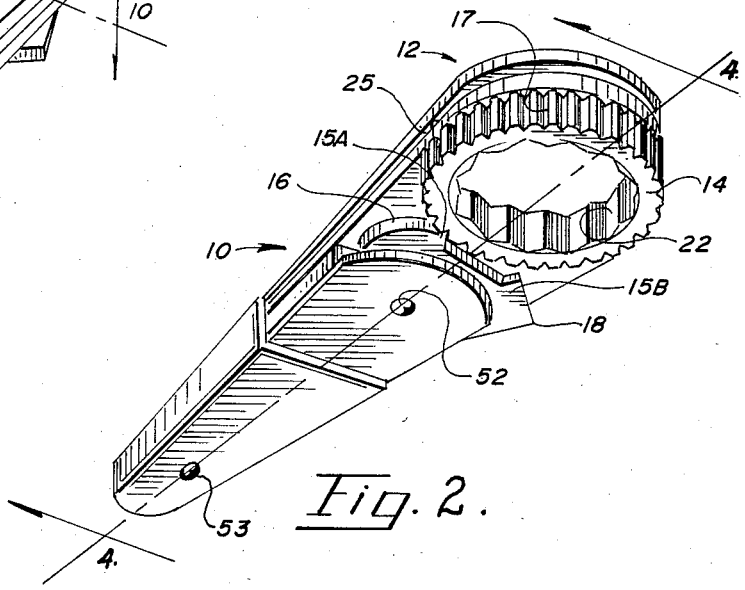
FIG. 2 shows a bottom isometric view of the invention.

FIG. 2 shows a further isometric view of handle drive mechanism 10, with a nut drive tool 14 attached thereto. Nut drive tool 14 has a plurality of circumferential teeth 17 for engagement against a ratchet pawl 16 which is pivotal about rivet 52. Ratchet pawl 16 has an ear 15*a* and a second ear 15*b*, either of which are engageable against and between teeth 17 for the proper ratcheting action. Pawl 16 has a projecting tab 18 which serves as a lever for enabling the pivoting motion of pawl 16 about rivet 52 to engage either ear 15*a* or 15*b* against teeth 17.

Figure 3:
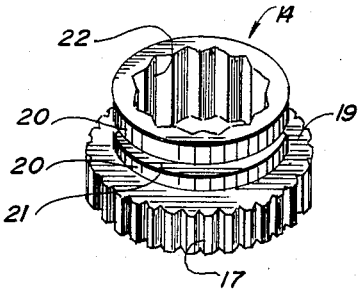
FIG. 3 shows an isometric view of one form of tool.

FIG. 3 shows an isometric view of nut drive tool 14, which is of generally cylindrical construction, having an upper cylindrical portion comprising a rotational bearing surface 20 and a lower cylindrical portion depending from a shoulder 19, and having a plurality of teeth 17. Bearing surface 20 has a circumferential groove 21 therein, into which may be engaged the forward edge of retainer plate 25 to secure nut drive tool 14 to handle drive mechanism 10. The inside surface 22 of nut drive tool 14 is formed into a circumferential arrangement of flats of proper size to engage against standard nut and bolt dimensions. Surface 22 may have a general hexagon pattern for grasping nuts and bolts in the conventional manner, or it may have any of a number of conventional shapes typically used in wrenches of this type for grasping and rotating nuts and bolt. Typically, a plurality of nut drive tools 14 are constructed for use with a single handle drive mechanism 10, each of the plurality of nut drive tools 14 being sized internally at surface 22 to accommodate a different standard size nut or bolt. Size selections may be made in any convenient manner, and may include standard S.A.E. wrench sizes as well as metric sizes.

Figure 4:
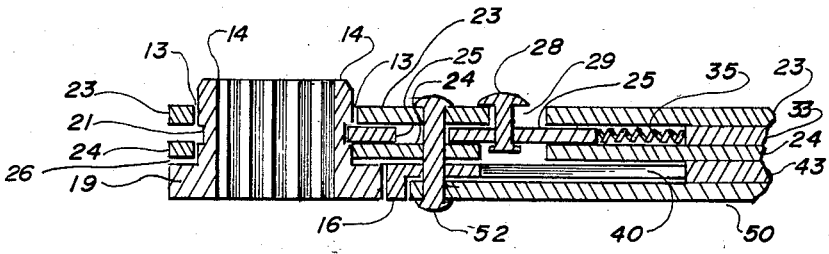
FIG. 4 shows a cross-sectional view taken along the lines 4—4 of FIG. 2.

FIG. 4 shows a cross-sectional view of handle drive mechanism 10 and nut drive tool 14, taken along the line 4—4 as shown in FIG. 2. Handle drive mechanism 10 is preferably formed from a plurality of layers, preferably made from sheet steel or similar stock. A top plate 23 is aligned with an intermediate plate 24, both of which have a head bore 13 of identical size projecting therethrough. A spacer plate 33 is clamped between top plate 23 and intermediate plate 24. A bottom plate 50 is affixed to this assembly, with an intermediate spacer plate 43 clamped between bottom plate 50 and intermediate plate 24. All of these plates are held together in fixed relationship by a rivet 53 proximate one end of handle mechanism 10 and by a second rivet 52 proximate the other end, and by additional rivets, if necessary. A retainer plate 25 is slidably contained between top plate 23 and intermediate plate 24, and is thinner than spacer plate 33 in order to permit free sliding movement of retainer plate 25. Retainer plate 25 is spring biased toward head bore 13 by means of spring 35, which is supported against spacer plate 33. Pawl 16 is pivotally movable in the space between intermediate plate 24 and bottom plate 50, by virtue of being thinner than spacer plate 43, and is pivotal about rivet 52. A pawl spring 40, preferably in the form of an over-center band spring, is urged between spacer plate 43 and pawl 16. A release button 28 is fixedly attached to retainer plate 25, and is movable within a slot 29 in top plate 23.

Nut drive tool 14 is insertable in bore 13, and retainer plate 25 is engageable into circumferential groove 21. In this position, shoulder 19 of nut drive tool 14 is supportable against the underside of intermediate plate 24, thereby forming a bearing surface 26 therebetween.

Figure 5:
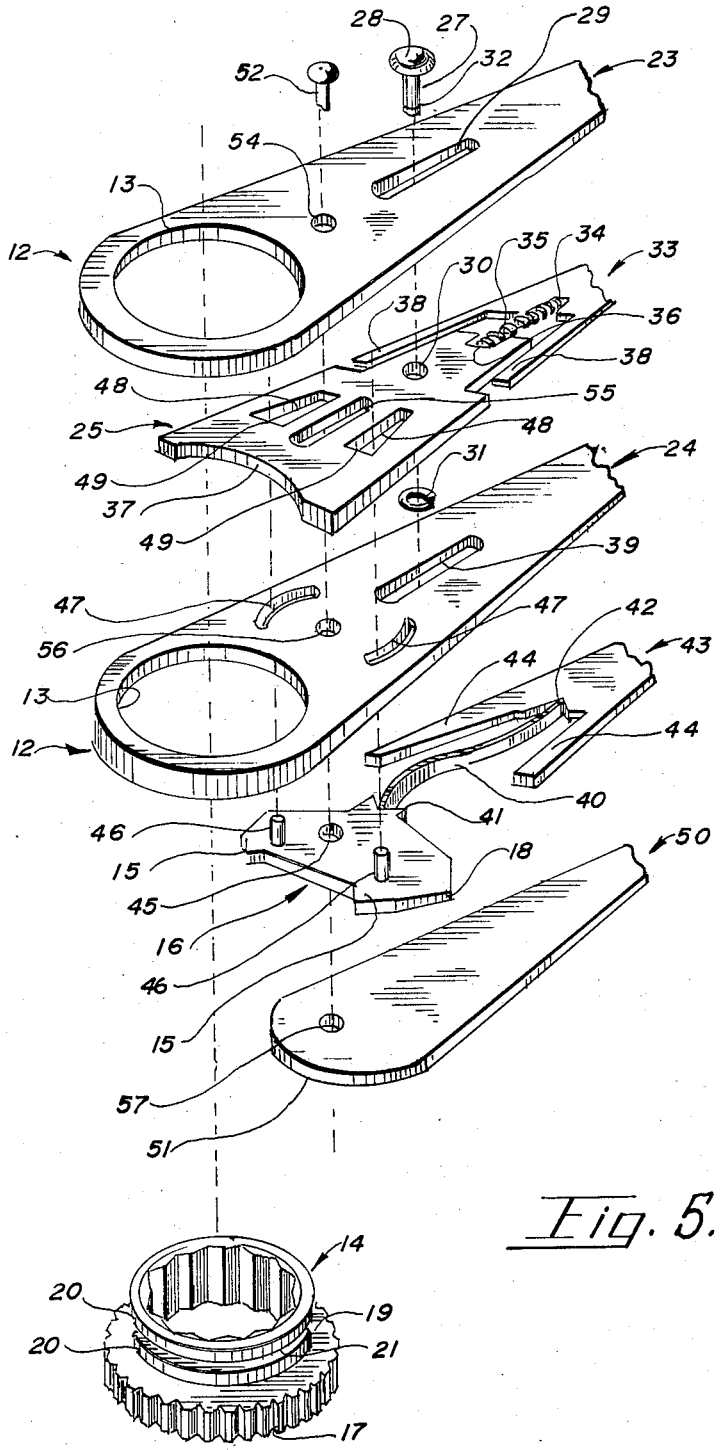
FIG. 5 shows an exploded isometric view of a preferred embodiment.

FIG. 5 shows a preferred embodiment of the invention in exploded view, illustrating the shapes of the respective components, as well as their interconnecting fit. Top plate 23 has a circular bore 13 through head 12, and has an elongated slot 29 sized large enough to loosely accept the shank 27 of release button 28. Release button 28 has a shank 27, and a lower groove 32 for accepting a locking washer 31. Shank 27 projects through hole 30 in retainer plate 25, and slot 39 in intermediate plate 24 is large enough to permit freedom of slidable movement of shank 27 and locking washer 31. Top plate 23 also has a hole 54 for insertion of rivet 52. It is to be noted that each of the plates forming handle drive mechanism 10 have an opening in alignment with hole 54, so that rivet 52 may be inserted the entire way through handle mechanism 10.

Spacer plate 33 has an exterior shape generally conforming to the exterior shape of top plate 23, extending at least partially along the length of handle drive mechanism 10. However, spacer plate 33 terminates in a pair of edge arms 38, and one end of retainer plate 25 is slidable therebetween. Retainer plate 25 is spring biased away from spacer plate 33 by means of a spring 35, which is secured between notch 34 on spacer plate 33 and notch 36 on retainer plate 25. Retainer plate 25 has a pair of slots 48 which enable the pivotal motion of pawl 16 in a manner to be hereinafter described. A center slot 55 on retainer plate 25 is of elongated shape, to permit transverse motion of retainer plate 25 relative to rivet 52. The front edge of retainer plate 25 has a curved leading edge 37, the radius of curvature being approximately the same as the radius of groove 21 of nut drive tool 14.

Intermediate plate 24 is externally shaped to conform identically with top plate 23, and has an identical bore 13 therethrough. A hole 56 is positioned to accept rivet 52, and an elongated slot 39 is provided in approximate alignment with slot 29 along top plate 23. Slot 39 accommodates th sliding motion of release button shank 27 and lock washer 31. A pair of arcuate slots 47 are formed from a center point about hole 56. Slots 47 provide grooves for guiding lugs 46 which project therethrough, from pawl 16.

Spacer plate 43 has an external shape generally conforming to the outside dimensions of the other plates aligned therewith, and has a pair of extending arms 44 aligned with the edges of these plates. Pawl 16 is mounted in the same plane as spacer plate 43, but pawl 16 is of thinner dimension than spacer plate 43. Pawl 16 is pivotal about rivet 52, and has lugs 46 affixed thereto and projecting upwardly. A pawl spring 40 is engaged between a notch 42 on spacer plate 43, and a notch 41 on pawl 16. Pawl spring 40 is preferably in the form of a compressed band spring, so as to provide an over-center toggle mechanism in combination with pawl 16.

Bottom plate 50 is shaped externally to conform generally with the other plates with which it is aligned, having a curved forward end 51 which terminates short of bore 13. A hole 57 is formed in alignment with other similarly placed holes in pawl 16 (hole 45), intermediate plate 24 (hole 56), retainer plate 25 (slot 55), and top plate 23 (hole 54).

Figure 6:
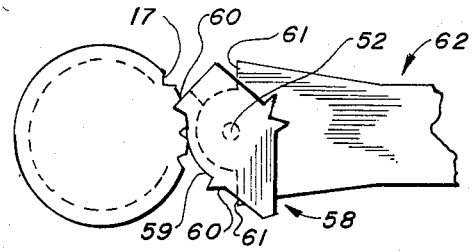
FIG. 6 shows a diagram of an alternative ratchet mechanism.
Figure 7:
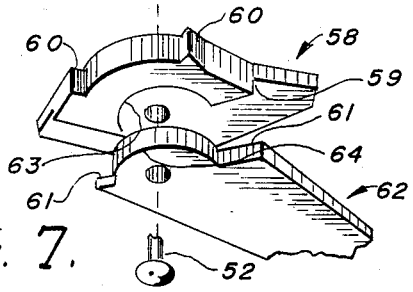
FIG. 7 shows a further isometric view of an alternative ratchet mechanism.

FIG. 6 and FIG. 7 illustrate an alternative construction of a ratchet mechanism operable with the present invention. This construction requires a slightly different forward end shape of the bottom plate, which has been identified as plate 62 for purposes of this explanation. A pawl 58 is constructed with a ridge 59 overhanging the forward edge of bottom plate 62, having a radius of curvature 63 generally conforming to the forwardly-curved edge 64 of bottom plate 62. Ridge 59 is engageable against shoulders 61 on bottom plate 62, and pawl 58 is pivotally mounted against an over-center toggle spring so that one of the rear edges of ridge 59 is engaged against one or the other shoulder 61. A pair of ears 60 project forwardly from ridge 59 for engagement against the teeth 17 of tool 14. Ratchet pawl 58 may be selectably moved from one position to the other by means of the lever which projects beyond the edge of bottom plate 62.

Figure 8:
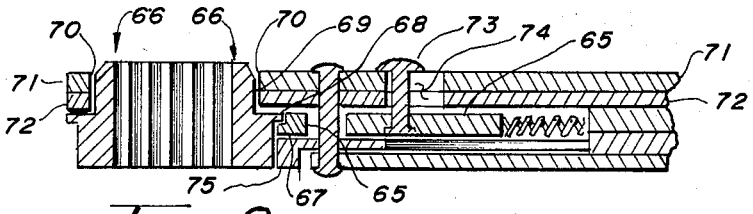
FIG. 8 shows a cross-sectional view of an alternative embodiment of the invention.

FIG. 8 shows a further alternative construction for the invention. In this figure, the circumferential groove 21 of tool 14 is replaced by an annular ridge 68 of tool 66. A slidable retainer plate 65 has a lip 67 which is engageable over annular ridge 68, and which may be retracted therefrom. Retainer plate 65 is movable by means of release button 73, which moves freely over slot 74. A head bore 70 is constructed through plate 71 and 72, and is sized so as to accept tool 66 and to allow free rotation of tool 66 about bearing surface 69. A pawl mechanism 75 is designed to engage a plurality of teeth circumferentially spaced about the lower portion of tool 66.

Figure 9:
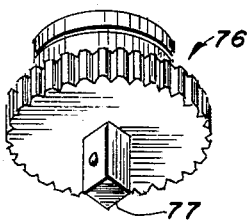
FIG. 9 shows an isometric view of a further tool.

FIG. 9 shows an alternative construction of a tool adaptable for use in the present invention. Tool 76 comprises a generally cylindrically-shaped tool having the parameters described hereinbefore, except that the bottom surface of the tooth portion of the tool is solid and has affixed thereto a projecting shank 77. Shank 77 is sized to accommodate a socket tool of the type generally used in commerce, and may be sized for example to accept sockets having $\frac{1}{8}$-inch, $\frac{1}{4}$-inch, $\frac{5}{8}$-inch or $\frac{1}{2}$-inch shank openings. Tool 76 therefore enables the present invention to become adaptable for accepting all of the well-known socket tools associated with socket wrenches of all types.

Figure 10:
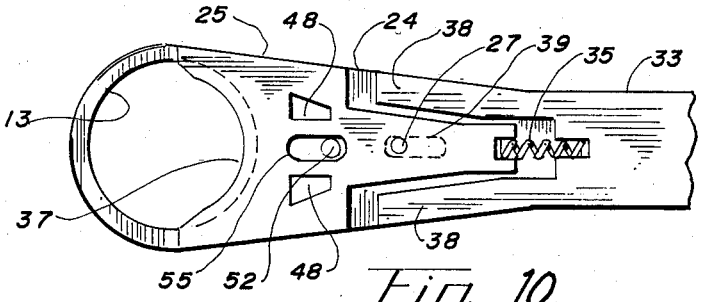
FIG. 10 shows a cross-sectional view taken along the lines 10—10 of FIG. 1.

FIG. 10 shows a cross-sectional view taken along the lines 10—10 of FIG. 1. There is shown the mechanical relationship between the respective working components associated with the insertion and removal of a tool into the handle mechanism. Retainer plate 25 has a curved leading edge 37 which is engageable into the opening formed by bore 13. Retainer plate 25 is slidable rearwardly against the force of compression spring 35, by slidably engaging release button 28 which is affixed to retainer plate 25 by its shank 27. Retainer plate 25 is movable rearwardly a distance determined by the length of slot 55, as well as the opening between retainer plate 25 and arms 38.

Figure 11B:
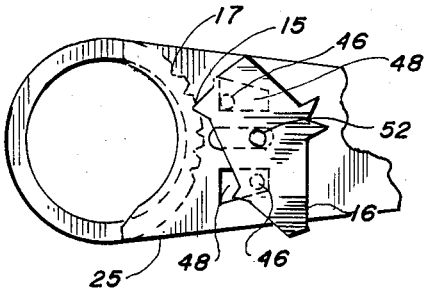
FIG. 11B shows the ratchet pawl disengaged in a second position.
Figure 11B:
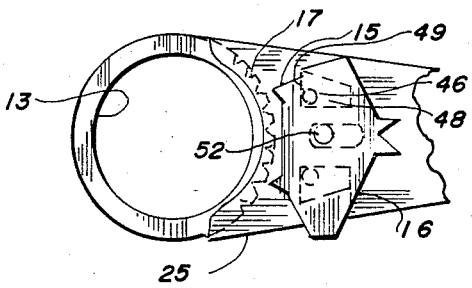

FIG. 11A shows a further operational aspect of the invention, and in particular shows the operative engagement between retainer plate 25 and lugs 46 on pawl 16. A partial circumferential outline of teeth 17 is shown in broken lines for purposes of illustrating the operation. Lugs 46 project upwardly into slots 48 of retainer plate 25, and a rearward sliding motion of retainer plate 25 causes the forward edge 49 of one of slots 48 to contact the forwardly positioned lug 46. This rearward contact of retainer plate 25 causes a pivotal rearward motion of the contacted lug 46, and thereby pivots pawl 16 about rivet 52, disengaging the ear 15 from contact with teeth 17. The disengaged position is shown in FIG. 11B, wherein retainer plate 25 is fully withdrawn from bore 13, and at the same time pawl 16 is forceably pivoted to a neutral position wherein neither ear 15 is engaged against teeth 17. In this position, the forward edge 49 of each of the slots 48 is engageable against a lug 46, and it is to be noted that no component is thereby engaged against any portion of the tool inserted in bore 13. The tool is therefore permitted to fall free from all engagement with handle drive mechanism 10 and may be removed therefrom.

In operation, the procedure for removing a tool from engagement with handle drive mechanism 10, and the procedure for inserting a tool into handle mechanism 10 is the same. In either case, release button 28 is slidably actuated away from bore 13 to not only disengage the retainer plate 25 from the bore, but also to disengage the pawl 16 from the teeth on the tool member. Once the tool member has been removed from the handle drive mechanism the release button may be disengaged to permit retainer plate 25 to return to its original position. Similarly, once a new tool has been inserted into bore 13, rearward pressure on release button 28 may be removed and spring 35 will urge retainer plate 25 into engagement with the stop member on the tool, and pawl 16 will be engaged against the teeth on the tool.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A ratchet wrench and removable tool combination comprising:

a handle member having a circular opening therethrough, proximate an end thereof, and having an interior slot opening into said circular opening;

a slidable finger in said interior slot, said slidable finger having a pair of elongate slots extending generally parallel to said interior slot opening;

an elongated opening in said handle member, extending generally parallel to said interior slot for a predetermined distance, said elongated opening thereby creating an elongated slot opening into said interior slot;

a pin affixed at one of its ends to said slidable finger and extending through said elongated slot; said pin being movable in said slot from a first position whereby said slidable finger extends into said circular opening, to a second position whereby said slidable finger is retracted from said circular opening;

a pivotable ratchet pawl mounted to said handle member; a pair of arcuate openings in said handle member between said slidable finger and said ratchet pawl and a pair of raised pins on said ratchet pawl, each of said pins extending through one of said arcuate openings and into one of said elongate slots in said slidable finger;

said removable tool comprising a cylindrical portion sized for fitting through said circular opening in said handle member, said cylindrical portion having a circumferential groove for receiving said slidable finger in said pin first position; and a toothed portion for engagement by said ratchet pawl.

2. The apparatus of claim 1, further comprising spring biasing means for urging said slidable finger toward said circular opening.

3. The apparatus of claim 2 further comprising overcenter spring toggle means for pivoting said ratchet pawl into either of two engagement positions with said toothed portion.

4. The apparatus of claim 3, wherein said removable tool further comprises a socket receiving member having an internal opening therethrough sized for receiving a fastener.

5. The apparatus of claim 3, wherein said removable tool further comprises a square shank sized for receiving a socket wrench tool.

6. A ratcheting socket wrench having a removable tool socket comprising:

a handle member having a tool receiving bore therethrough proximate an end of said handle member;

a slidable plate in said handle member, said plate having a concave curved end facing said bore and being slidable from a first position wherein said curved end projects into said bore to a second position wherein said curved end withdraws from said bore; said plate further having a pair of elongated slots therethrough, elongated in the direction of sliding of said slidable plate;

a ratchet pawl pivotably attached to said handle member; said ratchet pawl having a pair of raised projections, each of said projections extending into one of said plate elongated slots whereby at least one of said projections is engaged by slidable movement of said plate;

a tool member having a cylindrical portion sized for fitting into said bore, said cylindrical portion having a circumferential stop engageable by the concave curved end of said slidable plate, and having a circumferential toothed portion engageable by said ratchet pawl.

7. The apparatus of claim 6, further comprising spring biasing means for urging said slidable plate toward said bore.

8. The apparatus of claim 7, further comprising a tab attached to said slidable plate and outwardly projecting from said handle member.

9. The apparatus of claim 8, further comprising toggle spring means for urging said ratchet pawl into either of two engagement positions against said circumferential toothed portion.

10. The apparatus of claim 7, wherein said tool member circumferential stop further comprises a circumferential groove.

11. The apparatus of claim 7, wherein said tool member circumferential stop further comprises a circumferential shoulder.

12. The apparatus of claim 7, wherein said tool member further comprises a multi-faceted opening therethrough sized for receiving a threaded fastener.

13. The apparatus of claim 7, wherein said tool member comprises a square shank sized for receiving a further socket wrench tool.

* * * * *